US005522715A

United States Patent [19]

Watanabe et al.

[11] Patent Number: 5,522,715

[45] Date of Patent: Jun. 4, 1996

[54] HORIZONTAL SCROLL COMPRESSOR HAVING OIL PATH EXTENDING TO UPPER PART OF THRUST FACE OF COMPRESSOR STRUCTURE

[75] Inventors: Kazuhide Watanabe; Hisao Mizuno; Kimiharu Takeda, all of Nishi-Kasugai-gun, Japan

[73] Assignee: Mitsubishi Jukogyo Kabushiki Kaisha, Tokyo, Japan

[21] Appl. No.: 428,830

[22] Filed: Apr. 25, 1995

[30] Foreign Application Priority Data

Jun. 9, 1994 [JP] Japan ..... 6-127394

[51] Int. Cl.[6] ..... F01C 1/04

[52] U.S. Cl. ..... 418/55.1; 418/94; 184/6.16

[58] Field of Search ..... 418/55.1, 83, 91, 418/94; 417/902; 184/6.16

[56] References Cited

U.S. PATENT DOCUMENTS 4,940,396 7/1990 Shimizu et al. ..... 418/55.1

5,358,392 10/1994 Ukai ..... 418/94

FOREIGN PATENT DOCUMENTS 6002684 1/1994 Japan ..... 418/94

*Primary Examiner*—Charles Freay

*Attorney, Agent, or Firm*—Wenderoth, Lind & Ponack

[57] ABSTRACT

In a horizontal scroll compressor, a compressor structure and an electric motor, both disposed in a hermetic housing, are coupled with each other through a rotating shaft extending substantially horizontally. Lubricating oil accumulated in the bottom of the hermetic housing is supplied to a thrust face of a supporting frame of the compressor structure. To spread enough lubricating oil over the thrust face and prevent seizure and scoring of the thrust face, the lubricating oil is accumulated in a central concave part of the frame, and oil paths are provided to lead the lubricating oil to the upper part of the thrust face of the frame and to discharge excess lubricating oil from the lower part of the thrust face.

5 Claims, 3 Drawing Sheets

HORIZONTAL SCROLL COMPRESSOR HAVING OIL PATH EXTENDING TO UPPER PART OF THRUST FACE OF COMPRESSOR STRUCTURE

BACKGROUND OF THE INVENTION

1. Field of the Invention

The present invention relates to a scroll compressor which is installed horizontally.

2. Description of the Prior Art

FIG. 4 shows a longitudinal section of a conventional scroll compressor of a horizontally installed type. In this FIG. 4, a compressor structure 3 is coupled with an electric motor M through a horizontally extending rotating shaft 4, all within a hermetic housing 1. The compressor structure 3 has a fixed scroll 5 and a revolving scroll 6. The fixed scroll 5 is fixed to a frame 2. The revolving scroll 6, being engaged with the fixed scroll 5, is supported slidably by the frame 2.

The electric motor M consists of a rotor Ma and a stator Mb, the rotor Ma being fixed to the rotating shaft 4 and the stator Mb being fixed to the hermetic housing 1. One end of the rotating shaft 4 is supported by a bearing 7 provided in the frame 2. The other end of the rotating shaft 4 is supported by a bearing 8 and connected to an oil pump 11 which intakes lubricating oil 9 accumulated in the bottom of the hermetic housing 1 through an oil pipe 10.

The electric motor M drives the rotating shaft 4 and the revolving scroll 6 is driven thereby. The lubricating oil 9 accumulated in the bottom of the hermetic housing 1 is sucked up by the oil pump 11 and transferred through an oil path 4*a* provided within the rotating shaft 4 to lubricate an eccentric pin 4*b*, a drive bush 13, etc. of the rotating shaft and then the thrust face of the frame 2, etc. Excess oil is returned to an oil accumulator in the bottom of the hermetic housing 1 through a discharge oil path hole 12 extending through the frame 2. Thus, seizure and scoring of each part is prevented, and an increase of OC % (oil circulation ratio) and oil leakage into the compressor are prevented. The oil circulation ratio (OC %) is equal to:

$$\frac{\text{(Oil Weight)}}{\text{(Refrigerant Weight)} + \text{(Oil Weight)}} \times 100$$

FIG. 5 is a front view of the thrust face of the frame 2 of the compressor, wherein there are shown the frame 2, the thrust face 21, an annular oil groove 22 provided on the thrust face and a pair of horizontal oil grooves 23 extending to the right and to the left to the annular oil grooves 22 from a central part of the frame 2.

The lubricating oil supplied through the oil path 4*a* within the rotating shaft 4 flows to the annular oil groove 22 through the horizontal oil grooves 23 and lubricates the thrust face 21.

The above conventional horizontal scroll compressor has, as shown in FIG. 4, a discharge oil path 12 to discharge the lubrication oil 9 in excess of that used for lubrication, and also has such horizontal oil grooves as shown in FIG. 5, for lubrication of the thrust face of the frame 2. In this system of lubrication in the prior art, however, there has been a problem in that the lubricating oil 9 easily flows out to the discharge oil path 12, not staying long enough at the frame 2. Thus, the lubricating oil 9 does not spread well over the thrust face, whereby seizure and scoring often occur on the thrust face of the frame 2 and of the rotating scroll 6.

SUMMARY OF THE INVENTION

It is therefore an object of the present invention to prevent seizure and scoring of the thrust face by causing enough lubricating oil to spread over the thrust face.

To this end, the present invention provides a horizontal scroll compressor wherein a compressor structure and an electric motor, both disposed in a hermetic housing, are coupled by a substantially horizontally extending rotating shaft and lubricating oil accumulated in the bottom of the hermetic housing is fed to a thrust face of a frame supporting the compressor structure, and which compressor has the following characteristics:

(1) a first oil path leads lubricating oil accumulated in a central concave part of the frame to the upper part of the thrust face and a discharge oil path discharges excess lubricating oil from the lower part of the thrust face, (2) an annular oil groove is provided in the thrust face, the lubricating oil is supplied to the annular oil groove by the first oil path which extends from the central concave part of the frame to the upper part of the annular groove, and the discharge oil path is connected to the lower part of the annular groove, (3) the first oil path may be an oil groove or a pair of inclined oil grooves extending upwardly in the thrust face from the central concave part of the frame to the annular oil groove provided in the thrust face, or still further may be an oil passage extending within the frame from the central concave part of the frame to the annular groove.

According to the present invention, because the lubricating oil is fed to the upper part of the thrust face and is discharged from the lower part of the thrust face, the oil flows down along the thrust face to uniformly lubricate the thrust face.

Because lubricating oil is led to the upper part of the annular groove and is discharged from its lower part, the annular groove ensures the uniform lubrication of the thrust face.

BRIEF DESCRIPTION OF THE DRAWINGS

FIG. 1(*b*) is a front view of the same;

FIG. 3(*b*) is a front view of the same;

DESCRIPTION OF THE PREFERRED EMBODIMENTS

The preferred embodiments of the present invention will be described with reference to the accompanying drawings.

Figure 1A:
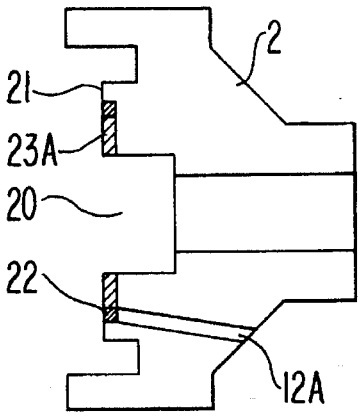
FIG. 1(*a*) is a longitudinal sectional view of a frame of compressor structure of a first embodiment of a horizontal scroll compressor according to the present invention.
Figure 1B:
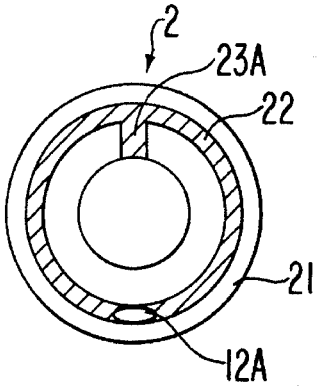

Referring first to FIGS. 1(*a*) and 1(*b*), the frame 2 of the scroll compressor includes a thrust face 21, an annular oil groove 22, and an upward oil groove 23A extending upwardly from the central part of the frame and connected to the annular oil groove 22. A discharge oil path 12A is connected to the bottom part of the annular groove 22. The other parts of the compressor are the same as those in the prior art.

In the scroll compressor of the present invention, the lubricating oil 9 supplied from the oil path 4*a* of the rotating shaft 4 to the frame 2 temporarily accumulates in the central concave part 20 of the frame 2. Then, the oil flows to the annular oil groove 22 through the upward oil groove 23A. The oil next flows from the upper part of the lower part of the annular oil groove 22 and thereby lubricates the thrust face 21. Then, the oil returns to the oil accumulator in the bottom of the hermetic housing 1 through the discharge oil path 12A. In this compressor, sufficient lubrication is attained because the oil naturally flows from the upper part of the thrust face to the lower part. Thus seizure and scoring of the thrust face, as well as an increase of OC % and oil leakage into the compressor can be prevented.

Figure 2:
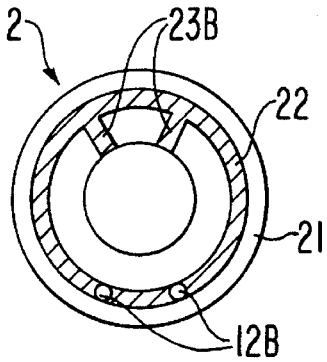
FIG. 2 is a front view of a frame of compressor structure of a second embodiment of a horizontal scroll compressor according to the present invention.

FIG. 2 shows a front view of a thrust face of the frame pursuant to a second preferred embodiment. This frame includes a pair of inclined upward oil grooves 23B, and a pair of discharge oil path holes 12B connected to the annular oil groove 22. This lubricating structure provides the same effect as that of the first preferred embodiment.

Figure 3A:
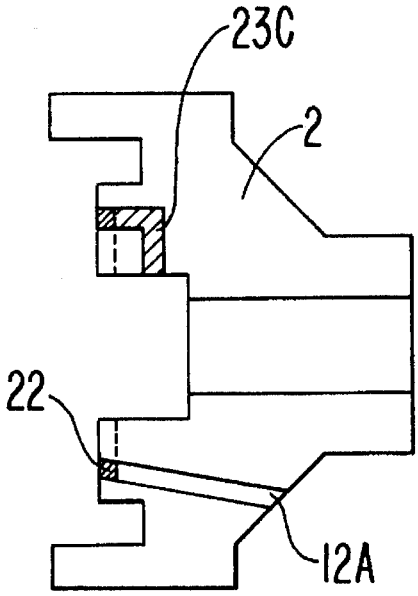
FIG. 3(*a*) is a longitudinal sectional view of a frame of compressor structure of a third embodiment of a horizontal scroll compressor according to the present invention.
Figure 3B:
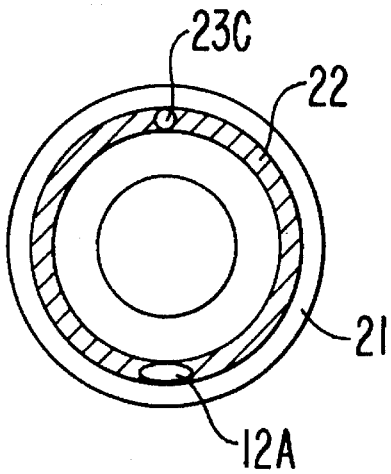
Figure 4:
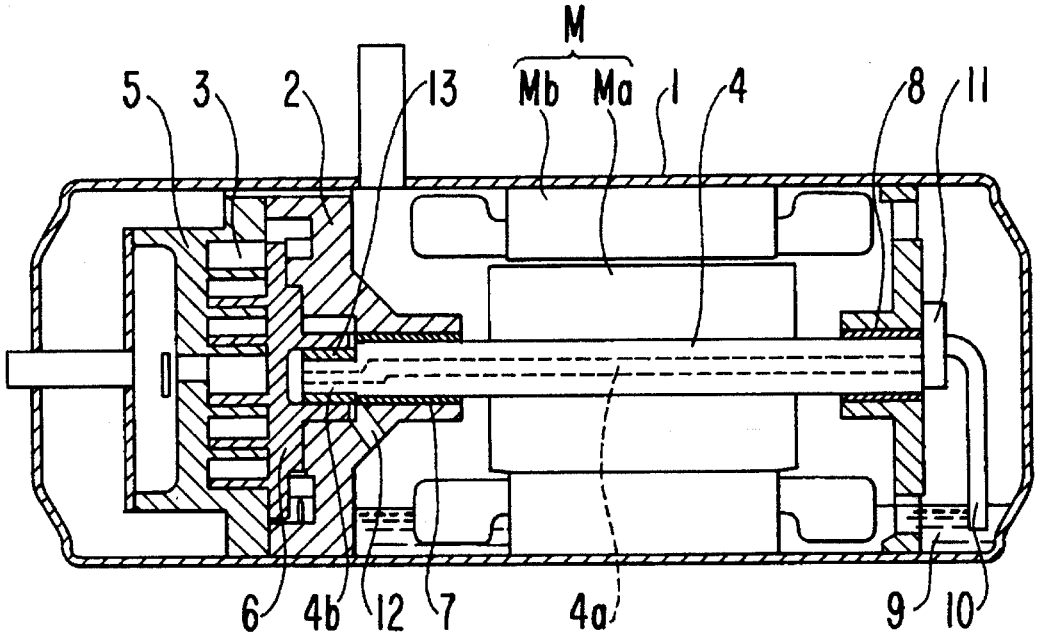
FIG. 4 (PRIOR ART)
FIG. 4 is a longitudinal sectional view of a prior art horizontal scroll compressor.
Figure 5:
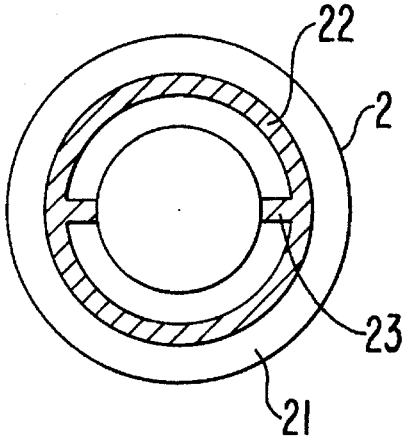
FIG. 5 (PRIOR ART)
FIG. 5 is a front view of the frame of the compressor structure of the prior art horizontal scroll compressor.

FIG. 3(*a*) and 3(*b*) show a frame of a third preferred embodiment of the present invention. In this frame, an upward oil path hole 23C extends within the frame 2, and provides the same effect as the upward oil groove 23A of the first preferred embodiment.

In the horizontal scroll compressor of the present invention, because the oil paths lead the lubrication oil accumulated in the central concave part of the frame onto the upper part of the thrust face of the frame and discharge excess lubrication oil from the lower part of the thrust face, the lubrication oil can spread sufficiently over the thrust face and can prevent seizure and scoring of the thrust face. Further, this effect is ensured because an annular oil groove is provided on the thrust face so that the oil accumulated in the central concave part of the frame and led to the upper part of the groove will continuously flow down to the lower part of the groove to reach the discharge oil path.

While the present invention has been explained specifically above on the basis of preferred embodiments of the invention illustrated in the accompanying drawings, it is a matter of course that the present invention should not be limited only to these preferred embodiments. Rather, various changes and modifications could be made to the configuration and structure of these embodiments within the scope of the present invention as defined by the appended claims.

We claim:

1. A horizontal scroll compressor comprising: a hermetic housing, a compressor structure having a supporting frame including a thrust surface, the thrust surface having an upper part and a lower part, an electric motor, both said compressor structure and said electric motor being disposed in said hermetic housing, a rotating shaft extending substantially horizontally in the housing and coupling said motor to said compressor structure, and an oil sump in the bottom of said hermetic housing and from which oil is to be supplied to said thrust surface of the supporting frame of said compressor structure, said supporting frame having a central concave part, a first oil path extending from said central concave part of said frame to the upper part of said thrust surface so as to lead lubricating oil accumulated in the central concave part of the frame to the upper part of the thrust surface, and a discharge oil path extending from the lower part of said thrust surface so as to discharge excess lubricating oil from said thrust surface at the lower part thereof.

2. A horizontal scroll compressor as claimed in claim 1, wherein said frame also has an annular oil groove in said thrust surface, said annular groove having an upper part which is connected to said first oil path and a lower part which is connected to said discharge oil path.

3. A horizontal scroll compressor as claimed in claim 2, wherein said first oil path comprises a groove extending in said thrust surface from the central concave part of the frame to the upper part of said annular oil groove.

4. A horizontal scroll compressor as claimed in claim 2, wherein said first oil path comprises a pair of grooves in said thrust surface, said grooves each being inclined relative to a vertical plane, and said grooves each extending from the central concave part of the frame to the upper part of said annular oil groove.

5. A horizontal scroll compressor as claimed in claim 2, wherein said first oil path comprises a passageway extending within the frame upwardly from the central concave part of the frame to the upper part of said annular oil groove.

* * * * *